US010462575B2

(12) United States Patent
Mu et al.

(10) Patent No.: US 10,462,575 B2
(45) Date of Patent: Oct. 29, 2019

(54) VOICE COIL WIRE, VOICE COIL WOUND BY THE VOICE COIL WIRE, AND LOUDSPEAKER PROVIDED WITH THE VOICE COIL

(71) Applicant: GoerTek Inc., Weifang (CN)

(72) Inventors: Zongjun Mu, Weifang (CN); Minghui Shao, Weifang (CN)

(73) Assignee: GoerTek Inc., Weifang (CN)

( * ) Notice: Subject to any disclaimer, the term of this patent is extended or adjusted under 35 U.S.C. 154(b) by 0 days.

(21) Appl. No.: 15/760,178

(22) PCT Filed: Dec. 7, 2015

(86) PCT No.: PCT/CN2015/096598

§ 371 (c)(1),
(2) Date: Mar. 14, 2018

(87) PCT Pub. No.: WO2017/054315

PCT Pub. Date: Apr. 6, 2017

(65) Prior Publication Data

US 2018/0332399 A1 Nov. 15, 2018

(30) Foreign Application Priority Data

Sep. 28, 2015 (CN) ..... 2015 1 0628266

(51) Int. Cl.

| | |
|---|---|
| ***H04R 9/04*** | (2006.01) |
| ***H04R 9/02*** | (2006.01) |
| *H04R 9/06* | (2006.01) |

(52) U.S. Cl.

CPC ..... *H04R 9/046* (2013.01); *H04R 9/025* (2013.01); *H04R 9/022* (2013.01); *H04R 9/06* (2013.01)

(58) Field of Classification Search

None

See application file for complete search history.

(56) References Cited

U.S. PATENT DOCUMENTS 5,714,822 A * 2/1998 Kawano ..... H01F 5/00 310/179
2004/0076842 A1* 4/2004 Ishigaki ..... C09D 183/04 428/469

(Continued)

FOREIGN PATENT DOCUMENTS

CN 201319666 Y 9/2009
CN 101556360 A 10/2009

(Continued)

OTHER PUBLICATIONS

Machine translation of KR0172702 (Originally published in Korean on Mar. 30, 1999, Applicant: Daewoo), 1999.*
Search Report CN15/096598, dated Jun. 30, 2016.

*Primary Examiner* — Antim G Shah
(74) *Attorney, Agent, or Firm* — LKGlobal | Lorenz & Kopf, LLP

(57) ABSTRACT

A voice coil wire, a voice coil wound by the voice coil wire, and a loudspeaker provided with the voice coil, which relate to the technical field of electro acoustic products. The voice coil wire comprises a conductor layer having an electric conduction effect and an insulation layer surrounding an outer side of the conductor layer. The cross-section of the voice coil wire is a hexagon, and the side lengths of the hexagon are equal. The voice coil wire, the voice coil wound by the voice coil wire, and the loudspeaker provided with the voice coil of the application can solve the technical problems in the prior art such as a low volume ratio of the voice coil and a complicated winding process. According to the voice coil wire, the voice coil, and the loudspeaker provided with the voice coil of the application, the voice coil is high in volume ratio, small in volume, good in heat dissipation performance and its winding process is simple, and the loudspeaker is high in sensitivity, small in thickness and good in acoustic performance.

3 Claims, 2 Drawing Sheets

(56) References Cited

U.S. PATENT DOCUMENTS

| | | | | |
|---|---|---|---|---|
| 2008/0001016 | A1* | 1/2008 | Nierlich | H01F 41/04<br>242/437.3 |
| 2010/0194003 | A1* | 8/2010 | Shimogawa | H01F 17/04<br>264/618 |
| 2013/0330122 | A1* | 12/2013 | Ghasiri | F16F 1/045<br>403/327 |

FOREIGN PATENT DOCUMENTS

| | | | |
|---|---|---|---|
| CN | 104811871 | A | 7/2015 |
| CN | 204498361 | U | 7/2015 |
| CN | 204498369 | U | 7/2015 |
| CN | 205017571 | U | 2/2016 |
| KR | 0172702 | B1 | 3/1999 |
| WO | WO 2017/054315 | | 6/2017 |

* cited by examiner

VOICE COIL WIRE, VOICE COIL WOUND BY THE VOICE COIL WIRE, AND LOUDSPEAKER PROVIDED WITH THE VOICE COIL

CROSS REFERENCE TO RELATED APPLICATIONS

This application is a National Stage entry of International Application No. PCT/CN2015/096598, filed on Dec. 7, 2015, which claims priority to Chinese Patent Application No. 201510628266.5, filed on Sep. 28, 2015. The disclosures of the priority applications are hereby incorporated in their entirety by reference.

TECHNICAL FIELD

The application relates to the technical field of electroacoustic products, and particularly relates to a voice coil wire and a voice coil wound by the voice coil wire and a loudspeaker provided with the voice coil.

BACKGROUND OF THE INVENTION

As an important acoustic component in portable electronic devices, a loudspeaker is an energy conversion device for converting sound wave electrical signals to sound signals and transmitting it out. A loudspeaker usually comprises a vibrating system and a magnetic circuit system. The vibrating system comprises a vibrating diaphragm and a voice coil combining together, and the voice coil is the driving component of the loudspeaker. When an alternating voice current passes through the voice coil, the voice coil generates a magnetic field changing with the voice current. The changing magnetic field and the magnetic field of the magnetic circuit system of the loudspeaker attract or repulse to enable the voice coil to generate mechanical vibration that cuts the magnetic field lines, thereby driving the vibrating diaphragm to vibrate and make sound. The conventional voice coils are usually wound by voice coil wires having a circular cross-section, the structure of which is shown in FIG. 1. As shown in FIG. 1, the voice coil is wound by a voice coil wire 10*a* having a circular cross-section. Gaps will inevitably occur in the winding process of the voice coil wire of such a structure. Moreover, the conductors occupy a small proportion of the sectional area of the voice coil while magnetic gaps occupy more space. Therefore, the voice coil has a low volume utilization ratio, and the presence of air gaps adversely affects heat dissipation of the voice coil.

Presently, products are required to be lighter and thinner and have more power and better heat dissipation. In order to achieve these objects, it is required to more effectively use the air gaps existing between the circular voice coil wires. Usually, the compression method is used to reduce the air gaps between the voice coil wires. However, the compression method cannot completely eliminate the air gaps. Moreover, it has the problems that compression will rupture the insulation layer of the voice coil wire and result in a short circuit, and the glue adhesive force between the layers will be destroyed or reduced. In addition, the compression is irregular, and the wires cannot be controlled to be uniformly compressed.

There is also a voice coil wire having a square cross-section. This type of voice coil wire effectively improves the volume utilization ratio of the voice coil. However, inclination will occur during winding and changing the square wire, and inclination and distortion will occur when arranging two and more layers of the voice coil wires, which also results in many air gaps. In addition, the winding process is complicated, and the shape of voice coil obtained is irregular.

SUMMARY OF THE INVENTION

Regarding the above defects, the first technical problem that the application seeks to solve is to provide a voice coil wire. The voice coil wire can enhance the volume utilization ratio and heat dissipation capability of the voice coil, and can effectively reduce the width and height of the voice coil.

On the basis of the same inventive concept, the second technical problem that the application seeks to solve is to provide a voice coil. The gaps between adjacent voice coil wires of the voice coil are small, and the voice coil has enhanced volume utilization ratio and heat dissipation performance as well as reduced height and width.

On the basis of the same inventive concept, the third technical problem that the application seeks to solve is to provide a loudspeaker. The loudspeaker has a high sensitivity and a small thickness.

In order to solve the first technical problem, the technical solution of the application is a voice coil wire, comprising a conductor layer having an electric conduction effect and an insulation layer which surrounds an outer side of the conductor layer, wherein a cross-section of the voice coil wire is a hexagon, and side lengths of the hexagon are equal.

Optionally, a circular arc chamfer is provided between every two adjacent sides of the hexagon, and a radius of the circular arc chamfer is less than ½ of the side lengths of the hexagon.

Optionally, a self-adhering layer is provided to surround an outer side of the insulation layer.

Optionally, the conductor layer is one of a copper wire, an extra-high tension copper wire or a copper clad aluminum wire.

In order to solve the above second technical problem, the technical solution of the application is a voice coil, wound by a voice coil wire, wherein the voice coil wire is the above voice coil wire.

In order to solve the above third technical problem, the technical solution of the application is a loudspeaker, comprising a vibrating system and a magnetic circuit system, the vibrating system comprising a vibrating diaphragm and a voice coil combining together, wherein the voice coil is the above voice coil.

The advantageous effects of the above technical solutions of the application are as follows.

The cross-section of the voice coil wire of the application is a hexagon, and the six side lengths of the hexagon are equal. As shown in FIG. 3, when the voice coil wires having a hexagon cross-section are wound, the wires closely contact with each other surface-to-surface, and there are not big air gaps between the wires. Therefore, compared with the voice coil wires in the prior art, the voice coil wire of the application has the following advantages:

I. To obtain the same voice coil resistance value, the length of voice coil wire required by the voice coil wound by the voice coil wire having a hexagon cross-section of the application is the same as that required by the voice coil wound by the voice coil wire having a circular cross-section, but the voice coil wound by the voice coil wire of the application has a smaller width and a smaller height, which provides a larger space for enlarging the magnetic circuit system of the loudspeaker, and can effectively increase the volume of the magnetic circuit system, thereby improving the magnetic field intensity.

II. If the cross-section areas are the same, the voice coil wire having a hexagon cross-section has a smaller gap ratio, and almost all contact areas are surface-to-surface contact. Compared with the voice coil wire having a circular cross-section, its air gap utilization ratio can be improved by 21%, the width can be reduced by 10%, and the height can be reduced by 13%. Accordingly, the voice coil wire having a hexagon cross-section can obtain a smaller magnetic gap and thus improve the sensitivity, and is advantageous to meet the loudspeaker design requirements on lighter weight, smaller thickness and higher sensitivity of output.

III. The voice coil wires having a hexagon cross-section contact each other surface-to-surface, so the glue contact area is large, the conductor contact area is large, and thus they will have enhanced heat dissipation capability and adhering reliability between the wires.

IV. The voice coil wound by can ensure a high volume utilization ratio without being compressed, which ensures the intactness of the insulation layer of the voice coil wire, and improves the stability and the reliability of the voice coil.

V. Compared with the voice coil wire having a tetragon cross-section, the structure of the voice coil wire having a hexagon cross-section is special, and can guide the winding when it is wound, so that every layer of voice coil wires can be limited and guided by the side edges and bottom edges of adjacent voice coil wires, which effectively reduces the deflection in the winding process and prevents the distortion of voice coil wires, obtains a voice coil having a regular shape, and makes the winding process simple and easy.

A circular arc chamfer is provided between every two adjacent sides of the hexagon, and a radius of the circular arc chamfer is less than ½ of the side lengths of the hexagon. The presence of the circular arc chamfers can enable the adhering glue to be well controlled at the joint points of the wire sides, which can further ensure the surface-to-surface close contact between the voice coil wires.

Since the voice coil of the application is wound by the above voice coil wire, the wires of the voice coil contact each other surface-to-surface, and the gaps between wires are small. So the voice coil will have enhanced volume utilization ratio and heat dissipation property as well as reduced height and width, which can effectively reduce the magnetic gap width of the loudspeaker, enlarge the volume of the magnetic circuit system of the loudspeaker, and further improve the magnetic field intensity of the loudspeaker, and thus the loudspeaker will have a higher sensitivity.

Since the voice coil of the loudspeaker of the application is the above voice coil, the loudspeaker of the application will have a small thickness and meet the product development trend of being thinner and lighter, while ensuring a strong magnetic field intensity obtained by the voice coil and improving the sensitivity.

In conclusion, the voice coil wire and the voice coil wound by the voice coil wire and the loudspeaker provided with the voice coil of the application solve the technical problems in the prior art such as a low volume ratio of the voice coil and complicated winding process. According to the voice coil wire and the voice coil wound by the voice coil wire and the loudspeaker provided with the voice coil of the application, the voice coil is high in volume ratio, small in volume, good in heat dissipation performance and its winding process is simple, and the loudspeaker is high in sensitivity, small in thickness and good in acoustic performance.

The above description is only an overview of the technical solutions of the application. In order to understand the technical means of the application more clearly, the special embodiments of the application are provided below.

BRIEF DESCRIPTION OF DRAWINGS

The drawings are intended to provide a further understanding of the application, and constitute a part of the description. The drawings are intended to interpret the application along with the embodiments of the application, and not to limit the application. In the drawings.

Figure 1:
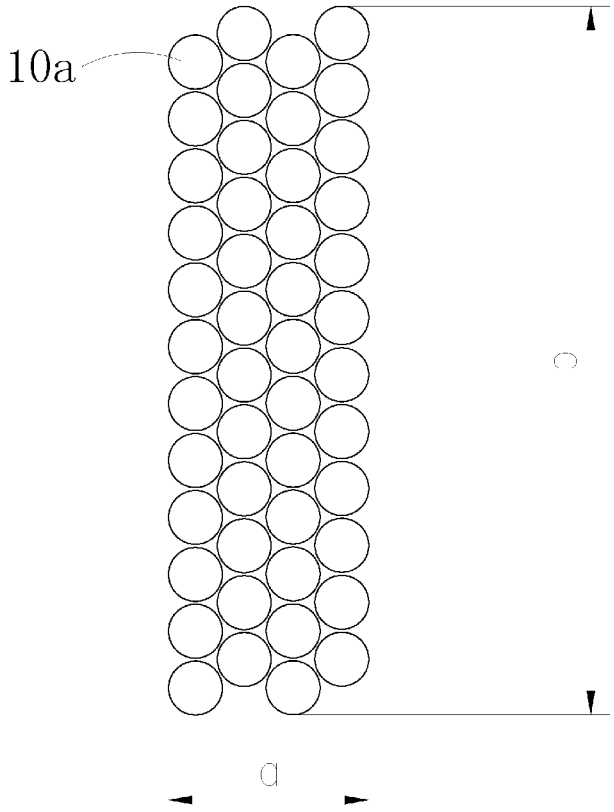
FIG. 1 is a schematic diagram of the cross-section of a voice coil wound by a voice coil wire in the prior art.

In the drawings: 10*a* is a voice coil wire, 10*b* is a voice coil wire, 10*c* is a voice coil wire, 100 is a conductor layer, 120 is an insulation layer, 130 is a self-adhering layer, and 140 is a chamfer.

DETAILED DESCRIPTION OF THE INVENTION

The present invention will now be described more fully hereinafter with reference to the accompanying DRAWINGS, in which preferred embodiments of the invention are shown. It is, of course, understood that this invention may, however, be embodied in many different forms and should not be construed as limited to the embodiments set forth herein; rather, these embodiments are provided so that the disclosure will be thorough and complete, and will fully convey the scope of the invention to those skilled in the art. It is, therefore, to be understood that other embodiments can be utilized and structural changes can be made without departing from the scope of the present invention.

The application will be further illustrated below by referring to the drawings and the embodiments.

First Embodiment

Figure 2:
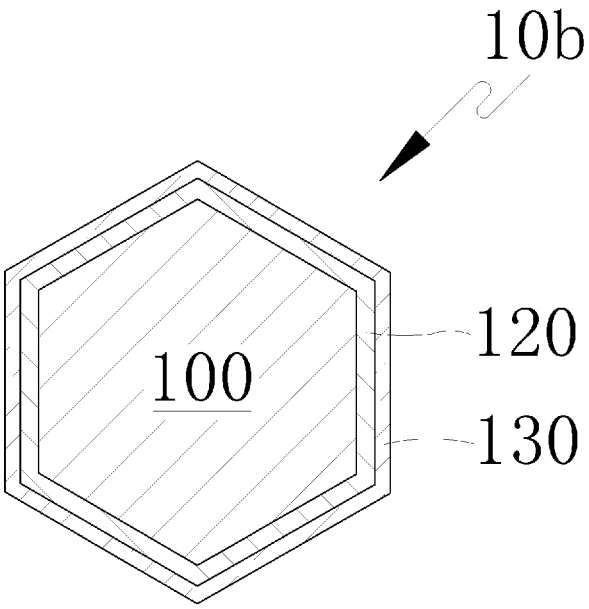
FIG. 2 is a schematic diagram of the cross-section structure of the voice coil wire in accordance with the first embodiment of the application.

As shown in FIG. 2, a voice coil wire 10*b* comprises a conductor layer 100 which is electrically conducting and is located on the innermost side, an insulation layer 120 surrounding and wrapping the outer side of the conductor layer 100, and a self-adhering layer 130 surrounding and wrapping the outer side of the insulation layer 120. The conductor layer 100 is one of a copper wire, an extra-high tension copper wire, a copper clad aluminum wire or other alloy wires, but is not limited thereto, and all materials usually used for the core of enameled wires may be used.

As shown in FIG. 2, the cross-section of the voice coil wire 10*b* is a hexagon; namely, the cross-section of its conductor layer 100 is a hexagon, and the cross-sections of its insulation layer 120 and self-adhering layer 130 are both hollow hexagons surrounding the outer side of the conductor layer 100, so that the cross-section of the whole voice coil wire 10*b* is a hexagon. The side lengths of the hexagon are equal, namely, it is a regular hexagon.

The voice coil wire 10*b* having a hexagon cross-section of the application can realize surface-to-surface contacts between the wires when it is wound to form a voice coil, which can effectively improve the volume utilization ratio and heat dissipation performance of the voice coil, effectively reduce the width and height of the voice coil, and reduce the difficulty in forming the voice coil.

Second Embodiment

Figure 4:
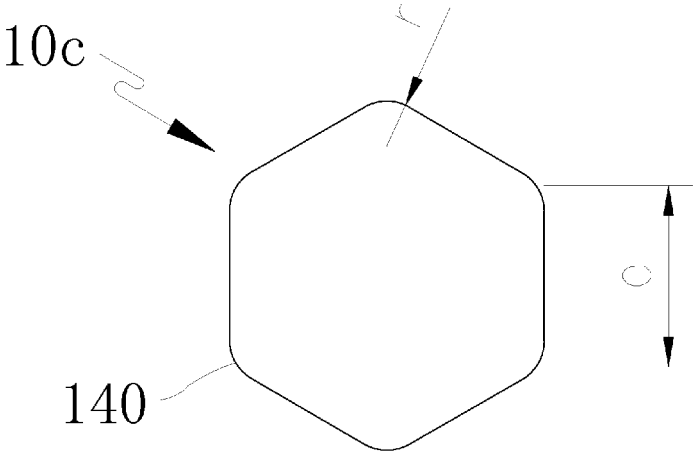
FIG. 4 is a schematic diagram of the structure of the voice coil wire in accordance with the second embodiment of the application.

The present embodiment is substantially the same as the first embodiment except the difference described below As shown in FIG. 4, the cross-section of the voice coil wire 10*c* is also a regular hexagon, but a circular arc chamfer 140 is provided between every two adjacent sides of the hexagon. Assuming that the side lengths of the hexagon are e and the radius of the circular arc chamfer 140 is r, the radius r is less than ½ of the side lengths e.

Compared with the first embodiment, the present embodiment, by providing the circular arc chamfers, can well control the adhering glue at the joint points of the wire sides, and obtain closer surface-to-surface contact between the voice coil wires as well as smaller gaps.

Third Embodiment

Figure 3:
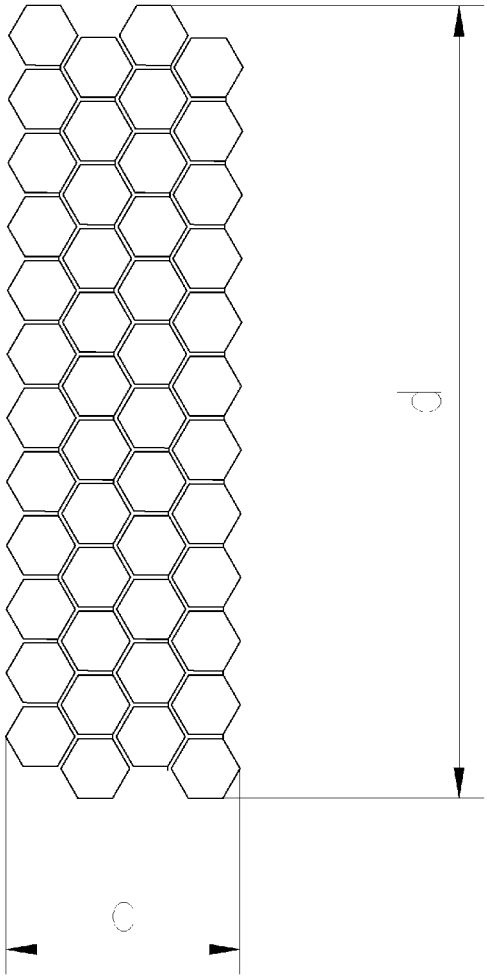
FIG. 3 is a schematic diagram of the cross-section of a voice coil of the application.

The present embodiment provides a voice coil, as shown in FIG. 3, which is wound by the voice coil wire in accordance with the first or second embodiment.

Compared with a conventional voice coil wound by the voice coil wire having a circular cross-section, the volume utilization ratio of the voice coil in accordance with the present embodiment can be improved by 21%, its width c is approximately 10% smaller than the width a of the conventional voice coil (see FIG. 1), and its height d is approximately 13% smaller than the height b of the conventional voice coil. Therefore, the voice coil of the present embodiment will have enhanced volume utilization ratio and heat dissipation performance as well as reduced height and width, which can effectively reduce the magnetic gap width of the loudspeaker, provide the corresponding space for enlarging the volume of the magnetic circuit system of the loudspeaker, and further improve the magnetic field intensity of the loudspeaker, and thus the loudspeaker will have a higher sensitivity.

Fourth Embodiment

The present embodiment provides a loudspeaker, comprising a vibrating system and a magnetic circuit system, and the vibrating system comprises a vibrating diaphragm and a voice coil combining together. The voice coil is the voice coil in accordance with the third embodiment.

Since the loudspeaker of the present embodiment uses the voice coil in accordance with the third embodiment, it will have a smaller thickness and meet the product development trend of being thinner and lighter, while ensuring a strong magnetic field intensity obtained by the voice coil and improving the sensitivity.

The application is not limited to the above special embodiments. All variations made by a person skilled in the art from the above concept without paying creative work shall fall within the protection scope of the application.

What is claimed is:

1. A voice coil wire, comprising:

a conductor layer having an electric conduction effect and an insulation layer which surrounds an outer side of the conductor layer, wherein a cross-section of the voice coil wire is a hexagon, and side lengths of the hexagon are equal;

wherein a circular arc chamfer is situated between adjacent sides of the hexagon, and a radius of the circular arc chamfer is less than ½ of the side lengths of the hexagon;

wherein the conductor layer is one of a copper wire, an extra-high tension copper wire or a copper clad aluminum wire; and wherein the voice coil further comprises a self-adhering layer to surround an outer side of the insulation layer, and cross-sections of the insulation layer and the self-adhering layer are both hollow hexagons surrounding the outer side of the conductor layer.

2. A voice coil wound by a voice coil wire, wherein the voice coil wire comprises a conductor layer having an electric conduction effect and an insulation layer which surrounds an outer side of the conductor layer, and wherein a cross-section of the voice coil wire is a hexagon, and side lengths of the hexagon are equal;

wherein a circular arc chamfer is situated between adjacent sides of the hexagon, and a radius of the circular arc chamfer is less than ½ of the side lengths of the hexagon;

wherein the conductor layer is one of a copper wire, an extra-high tension copper wire or a copper clad aluminum wire; and wherein the voice coil further comprises a self-adhering layer to surround an outer side of the insulation layer, and cross-sections of the insulation layer and the self-adhering layer are both hollow hexagons surrounding the outer side of the conductor layer.

3. A loudspeaker, comprising:

a vibrating system and a magnetic circuit system, the vibrating system comprising a vibrating diaphragm and a voice coil combining together, wherein the voice coil is wound by a voice coil wire, the voice coil wire comprising a conductor layer having an electric conduction effect and an insulation layer which surrounds an outer side of the conductor layer, and wherein a cross-section of the voice coil wire is a hexagon, and side lengths of the hexagon are equal;

wherein a circular arc chamfer is situated between adjacent sides of the hexagon, and a radius of the circular arc chamfer is less than ½ of the side lengths of the hexagon;

wherein the conductor layer is one of a copper wire, an extra-high tension copper wire or a copper clad aluminum wire; and wherein the voice coil further comprises a self-adhering layer to surround an outer side of the insulation layer, and cross-sections of the insulation layer and the self-adhering layer are both hollow hexagons surrounding the outer side of the conductor layer.

* * * * *